US010918130B2

(12) United States Patent
Camitta

(10) Patent No.: US 10,918,130 B2
(45) Date of Patent: Feb. 16, 2021

(54) HAND HELD WATER FILTER

(71) Applicant: MJ's Arsenal LLC, Denver, CO (US)

(72) Inventor: Josh Camitta, Denver, CO (US)

(73) Assignee: MJ'S ARSENAL LLC, Denver, CO (US)

( * ) Notice: Subject to any disclaimer, the term of this patent is extended or adjusted under 35 U.S.C. 154(b) by 0 days.

(21) Appl. No.: 16/377,536

(22) Filed: Apr. 8, 2019

(65) Prior Publication Data

US 2019/0230980 A1 Aug. 1, 2019

Related U.S. Application Data

(63) Continuation-in-part of application No. 15/796,623, filed on Oct. 27, 2017, now Pat. No. 10,251,419.

(60) Provisional application No. 62/473,279, filed on Mar. 17, 2017.

(51) Int. Cl.
*A24F 1/30* (2006.01)
*A24F 13/06* (2006.01)

(52) U.S. Cl.
CPC ..... *A24F 1/30* (2013.01); *A24F 13/06* (2013.01)

(58) Field of Classification Search
None
See application file for complete search history.

(56) References Cited

U.S. PATENT DOCUMENTS

| | | | |
|---|---|---|---|
| 1,505,861 | A | 8/1924 | Carafilidis |
| 1,858,180 | A | 5/1932 | Bjornstad |
| 3,394,710 | A | 7/1968 | Ping-Chuan |
| 3,410,281 | A | 11/1968 | Ephron et al. |
| 4,071,035 | A | 1/1978 | Boyd et al. |
| 4,096,868 | A | 6/1978 | Norman |
| 4,165,753 | A | 8/1979 | Stryker |
| 4,638,815 | A | 1/1987 | Yoshioka |
| 4,648,410 | A | 3/1987 | Seroussi |
| 5,458,106 | A | 10/1995 | Kim |
| 5,476,110 | A | 12/1995 | Baig et al. |
| 6,568,400 | B1 | 5/2003 | Tinsky et al. |
| 8,205,621 | B1 | 6/2012 | Seeley |

(Continued)

FOREIGN PATENT DOCUMENTS

| | | |
|---|---|---|
| CA | 2561331 | 3/2008 |
| DE | 1016396 | 8/2002 |

(Continued)

OTHER PUBLICATIONS

The Dab Lab—Online Headshop, "Schmalex Nomad Banger Hanger Rig at TheDabLab.com," https://www.youtube.com/watch?v=AcKor5LKrrk, 7 pages, Sep. 23, 2015.

(Continued)

*Primary Examiner* — Michael H. Wilson
*Assistant Examiner* — Katherine A Will
(74) *Attorney, Agent, or Firm* — Brownstein Hyatt Farber Schreck, LLP

(57) ABSTRACT

A hand-held water filter for filtering smoke or vapor to be inhaled by the user. The water filter includes a tapered receptacle that is integrally formed with the vessel body of the water filter and configured to receive a smoking or vaporizing article. The water filter includes an integrated downtube configured to deliver smoke from the smoking or vaporizing article into a water reservoir prior to inhalation.

19 Claims, 17 Drawing Sheets

(56) References Cited

U.S. PATENT DOCUMENTS

| | | | | |
|---|---|---|---|---|
| 2014/0326256 | A1 | 11/2014 | McKay | |
| 2015/0122275 | A1* | 5/2015 | Wu | A24F 1/30 131/329 |
| 2016/0095351 | A1 | 4/2016 | Carrion | |

FOREIGN PATENT DOCUMENTS

| | | |
|---|---|---|
| GB | 1173848 | 12/1969 |
| GB | 1274168 | 5/1972 |
| WO | WO2001/074184 | 10/2001 |

OTHER PUBLICATIONS

The Dab Lab—Online Headshop, "Rawlins Glass Banger Hanger Rig—TheDabLab.com," https://www.youtube.com/watch?v=Wh4bGNI-w90, 6 pages, Aug. 28, 2015.

Potland TreeBlazer, "Golden Glob Off the Super Think Quartz Banger," https://www.youtube.com/watch?v=PdSg4upIK2s, 7 pages, Mar. 10, 2015.

* cited by examiner

HAND HELD WATER FILTER

CROSS-REFERENCE TO RELATED APPLICATION(S)

This application is a continuation-in-part patent application of U.S. patent application Ser. No. 15/796,623, filed Oct. 27, 2017 and titled "Water Filter Configured to Receive a Rolled Product," which is a nonprovisional patent application of and claims the benefit of U.S. Provisional Patent Application No. 62/473,279, filed Mar. 17, 2017 and titled "Water Filter Configured to Receive a Rolled Product," the disclosures of which are hereby incorporated herein by reference in their entireties.

FIELD

The described embodiments relate generally to water filters. More particularly, the present embodiments relate to a water filter that is configured to receive a rolled product or other apparatus.

BACKGROUND

Tobacco and other combustible products may typically be ingested through combustion and inhalation of the resulting smoke. Such smoke may be passed through a filtering method and/or a cooling method prior to entering the user's body. For instance, a cigarette may include a filter made from cellulose acetate fiber, paper, or activated charcoal, which may filter particulates in the smoke from burning tobacco.

Some traditional products, like hookahs, pull smoke from a metal cup through water or another type of liquid prior to inhalation. However, traditional hookahs are bulky and can be difficult to transport. Additionally, traditional hookahs are generally not configured to accept a rolled product, such as a cigarette. The following disclosure is directed to devices that overcome some of these limitations with traditional products or devices.

SUMMARY

Embodiments described herein generally relate to a water filter or water pipe for inhaling a combustible product, such as tobacco. The water filter may be specially configured to receive a rolled product, such as a rolled cigarette, and may accommodate various sizes and shapes of cigarettes. The water filter may also be adapted to receive a vaporizer or other apparatus for delivering vaporized product. In some embodiments, the water filter or water pipe includes a vessel body, a mouthpiece, a receptacle, and a downtube.

The vessel body may include an outer wall defining an internal water reservoir. The mouthpiece includes an opening through the outer wall of the vessel body and is positioned on an upper portion of the vessel body. A receptacle is designed to hold a rolled cigarette or other apparatus and delivers smoke or vapor into a lower portion of the water reservoir. The downtube couples to the receptacle. In some implementations, the downtube includes a chamber which is formed with the outer wall of the vessel body.

Some example embodiments are directed to a water filter having a vessel body including defining an internal cavity configured to retain a liquid. The water filter also includes a mouthpiece that is integrally formed and positioned on an upper portion of the vessel body and defines an opening through the outer wall. A receptacle is integrally formed with the vessel body and is configured to hold a rolled product. The water filter also includes a downtube that extends from the receptacle to some portion of the internal cavity. The downtube is configured to direct combusted or vaporized material from the rolled product into the retained liquid. In some instances, the vessel body defines a carburation port positioned above the receptacle. In some implementations, the vessel body, the mouthpiece, and the receptacle are integrally formed from a glass material. In some implementations, the vessel body, the mouthpiece, and the receptacle are integrally formed from a silicone material.

In some embodiments, the receptacle defines a conical surface. The conical surface may be configured to form a seal between the rolled product and the receptacle. In some implementations, the conical surface has an interior angle that ranges between 5 and 10 degrees.

In some embodiments, the receptacle defines a tapered surface having a first diameter at an outer end and a second diameter at an inner end. The first diameter may range between 10 mm and 20 mm. The second diameter is less than the first diameter and may range between 2 mm and 9 mm. The distance between the outer end and the inner end may be approximately 10 mm to 25 mm. In some cases, the first diameter may range between 12 and 16 mm, and the second diameter ranges between 3 mm and 6 mm. In some implementations, the tapered surface has a sand blasted surface finish that facilitates the seal between the rolled product and the receptacle.

The water filter may be configured to be held in a user's hand and the carburation port may be positioned above the receptacle by a distance that enables the carburation port to be covered by an index finger of the user's hand when the vessel body is being held.

In some cases, the downtube is formed from a glass material and the vessel body is formed from the same glass material. In some implementations, the downtube is integrally formed with the vessel body. Specifically, the downtube may include or define a chamber that is define, at least in part, by some portion of an outer wall of the vessel body.

Some example embodiments are directed to a water filter having a vessel body that defines an internal cavity configured to hold water in a lower region of the vessel body. The water filter may also include a mouthpiece that is coupled to an upper portion of the vessel body and defines an opening that extends into the internal cavity. The water filter may also include a receptacle formed integral with the vessel body and configured to receive a rolled product. A downtube may be coupled to the receptacle and have an outlet that is configured to be submerged by the water in the lower region of the vessel body.

The water filter may also include a carburation port defining an aperture in the glass vessel body positioned between the receptacle and a top of the glass vessel body. In some cases, the downtube includes an internal passage or chamber that is configured to transfer smoke or vaporized product from the receptacle into the water or liquid. The passage may be defined, in part, by an inner portion of the sidewall of the glass vessel body.

In some implementations, the receptacle defines a conical section that is configured to receive the rolled product. The conical section may define a first internal diameter at an opening of the receptacle and a second internal diameter located inward of the opening of the receptacle proximate to the vessel body. The first internal diameter may range between 10 and 20 mm, and the second internal diameter is less than the first diameter and ranges between 2 mm and 9 mm. In some cases, the first internal diameter may range between 12 and 16 mm, and the second internal diameter ranges between 3 mm and 6 mm.

In some implementations, the conical section includes a textured surface configured to facilitate a seal between the rolled product and the conical section. The conical section may have an interior angle that ranges between 5 and 10 degrees.

In some example embodiments, the vessel body includes an outer wall that defines the internal cavity. The downtube may include or define a chamber that is configured to receive combusted or vaporized product from the rolled product that passes through the receptacle. The chamber may be defined, in part, by the outer wall of the vessel body. The chamber may also include a chamber wall that defines the outlet that is submerged by the water in the lower region of the vessel body.

Some example embodiments are directed to a water filter having a glass vessel body having a sidewall defining an internal cavity that is configured to hold water. The water filter may also include a mouthpiece that is coupled to the glass vessel body and defines an opening into an upper portion of the internal cavity. The water filter may also include a receptacle integrated with the glass vessel body and defining a tapered surface that is configured to form a seal between the rolled product and the receptacle. A downtube extends into the internal cavity and is configured to transfer smoke or vaporized product from the receptacle to the water.

In some embodiments, the rolled product includes an end portion having a taper angle. The tapered surface of the receptacle may have an internal angle that is greater than the taper angle of the rolled product. In some implementations, the tapered surface defines a first internal diameter ranging between 10 mm and 20 mm and a second internal diameter ranging between 2 mm and 9 mm.

BRIEF DESCRIPTION OF THE DRAWINGS

The disclosure will be readily understood by the following detailed description in conjunction with the accompanying drawings, wherein like reference numerals designate like elements.

Figure 1A:
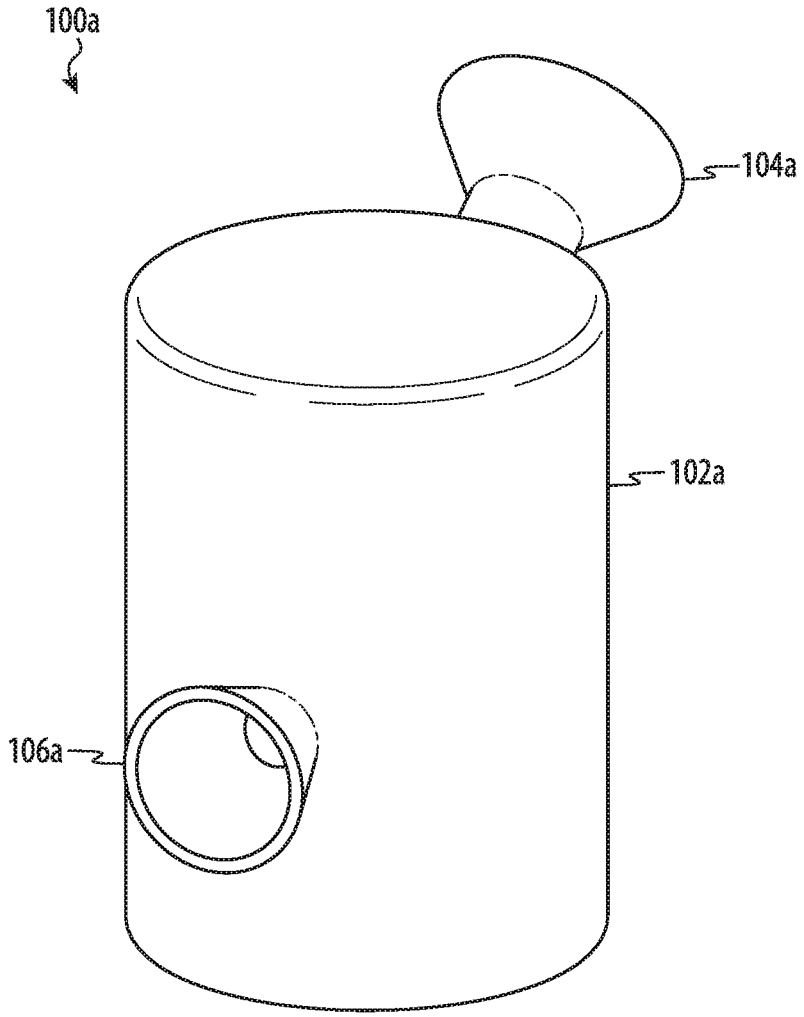
FIG. 1A depicts a first example of a water filter according to the present disclosure.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalties of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following descriptions are not intended to limit the embodiments to one preferred implementation. To the contrary, the described embodiments are intended to cover alternatives, modifications, and equivalents as can be included within the spirit and scope of the disclosure and as defined by the appended claims.

The following disclosure relates to a water filter or water pipe for smoking tobacco, a combustible product, and/or a vaporized product. In some cases, the water filter or water pipe may be configured to receive a rolled product, such as a cigarette. The water filter may also have a tapered surface that is configured to receive a vaporizer or vaporizer apparatus including, for example, a vaporizer bucket or a vaporizer pen. The water filter or water pipe typically includes a vessel body that defines a water reservoir which holds water or another liquid for filtration and/or cooling smoke prior to inhalation by a user. The water reservoir is typically partially filled with liquid, such that smoke which passes through the liquid is held within the reservoir in a portion of the vessel that is located above the liquid. A specially designed receptacle for the rolled product or vaporizer apparatus is coupled to or integrally formed with the vessel body. The receptacle may include a tapered or conical surface that is configured to hold the rolled product or vaporizer and form a seal between the rolled product or vaporizer and the receptacle. A mouthpiece may be coupled to or integrally formed with the vessel body and may be configured to allow a user to draw smoke or a vaporized product into the user's mouth after it has passed through the water.

Where some traditional products include a bowl or cup for holding combustible products, embodiments of the present disclosure include a receptacle shaped to receive a rolled product or a vaporizer apparatus. The receptacle may be attached to or integrally formed with the vessel body such that a cigarette will typically be held parallel or inclined with respect to a horizontal plane when in use. In some cases, the receptacle is inverted to allow for insertion of a vaporizer apparatus from below. The receptacle may have a conical shape, define a conical surface, or have a tapered opening that is specially configured to receive a rolled product or vaporizer apparatus. In some cases, the receptacle is configured to receive rolled product that may vary in size and shape. The rolled product may be placed within the receptacle and form a seal with the water reservoir. In some embodiments, the receptacle may also be textured to facilitate the formation of a seal when a cigarette or a vaporized apparatus is placed within the receptacle.

A downtube may be functionally coupled to the receptacle in order to pass smoke or vaporized product into the water held in the reservoir of the vessel body. Thus, as the downtube fills with smoke from a cigarette, the smoke or vaporized product will begin to pass through the water and into an upper portion of the water reservoir. Negative pressure may be created within the water reservoir, further drawing smoke through the water and into the reservoir. Once smoke or vaporized product enters the reservoir, the user may inhale the smoke or vapor through the mouthpiece.

In some embodiments described herein, the downtube is formed integral with the vessel body. The vessel body may include one or more outer walls, and an inner portion of the wall or inner surface may form a portion of the downtube. Such an embodiment may provide a simpler and/or more durable water filter design with fewer separate parts. In some cases, the vessel body, the receptacle, and the downtube are integrally formed from a single material, such as glass or other ceramic. In some cases the elements of the water filter are integrally formed from a silicone, polymer, or other type of material.

In many embodiments, the water filter may be small enough to be easily held within an average adult hand. For example, the user may hold the water filter in a single hand while operating a vaporizer apparatus or lighting the rolled product with the other hand. The water filter may accordingly be more portable, being easily carried by hand, within a pocket, on a necklace or keychain, or a similar method. An attachment point may be provided to facilitate attachment of the water filter to another object, such as a necklace.

These and other embodiments are discussed below with reference to FIGS. 1A-7B. However, those skilled in the art will readily appreciate that the detailed description given herein with respect to these figures is for explanatory purposes only and should not be construed as limiting.

FIGS. 1A-1F depict various examples of a water filter (e.g., water pipe) according to the present disclosure. As shown in FIG. 1A, a water filter 100*a* (e.g., a water pipe or bubbler) includes a vessel body 102*a*, a receptacle 106*a*, and a mouthpiece 104*a*. In many embodiments, the vessel body 102*a*, the receptacle 106*a*, and the mouthpiece 104*a* are integrally formed as a single body from a common material to define a monolithic component or monolithic piece. In other embodiments, one or more elements or components of the water filter may be separately formed.

In an example embodiment, the water filter 100*a* is formed from glass (e.g., borosilicate glass, lead glass, soda-lime glass, and so on). The water filter 100*a* may be formed from other suitable materials, such as acrylic, silicone, polymer (e.g., high-density polyethylene, polyvinyl chloride, polypropylene, and so on), metal (e.g., aluminum, steel, brass, and so on), wood, or ceramics (e.g., porcelain). In some embodiments, one or more of the vessel body 102*a*, receptacle 106*a*, and mouthpiece 104*a* are formed from distinct materials. In some embodiments, some or all of these components may be separable from one another.

The vessel body 102*a* is depicted as a cylinder, but may be formed in another shape suitable to form an internal cavity. For example, the vessel body 102*a* may be formed as a cube, a sphere, an ellipsoid (see FIGS. 2A-2C), and other geometric shapes (see, e.g., FIGS. 3-7B), including non-regular geometric shapes, which may include multiple internal volumes or chambers that may be interconnected (or, in some cases, isolated from each other). Typically, the mouthpiece 104*a* is positioned higher on the vessel body 102*a* than the receptacle 106*a*, though this is not required.

Figure 1B:
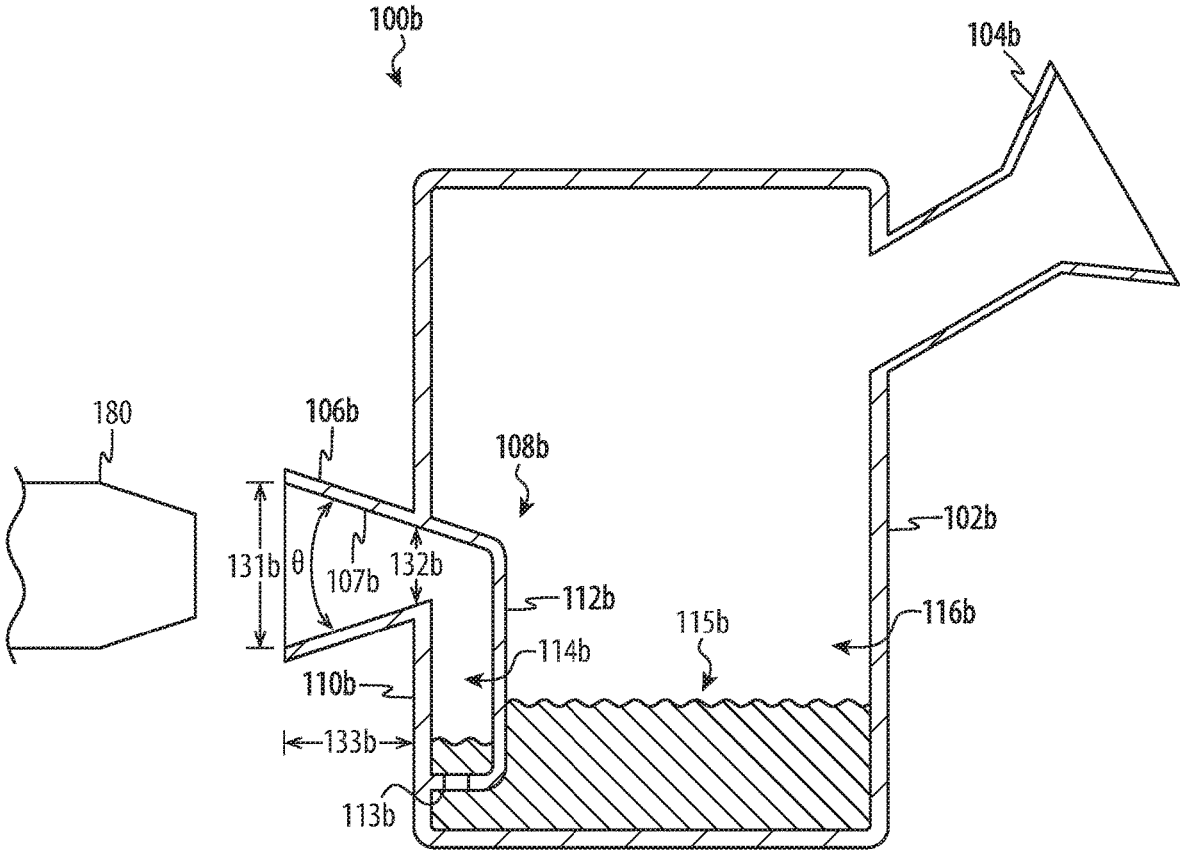
FIGS. 1B-1F depict an example cross-sectional views of a water filter.

Turning to FIG. 1B, an example cross sectional view of a water filter 100*b*, which may correspond to the water filter 100*a* depicted in FIG. 1A. As shown in FIG. 1B, the vessel body 102*b* forms a water reservoir 116*b* (e.g., a cavity). Smoke, combusted product, or vaporized product may be processed by the water filter 100*b* prior to inhalation by the user. For purposes of the discussion, smoke, combusted product, vaporized product or other gaseous form of a product or substance may be referred to herein simply as smoke.

In the example of FIG. 1B, smoke enters the water reservoir 116*b* through the receptacle 106*b*, passes through a downtube 108*b*, and into a lower portion of the water reservoir 116*b*. A user typically partially fills the water reservoir 116*b* with a liquid up to at least a millimeter above the outlet 113*b* or port of the downtube 108*b*, while leaving a (an upper) portion of the water reservoir 116*b* for accumulation of smoke which has passed through the water.

The vessel body 102*b* may be formed such that the water reservoir 116*b* may hold a suitable liquid. The liquid may filter and/or cool smoke which passes through it, delivering a more pleasant and/or lower particulate smoke to a user. Smoke is typically drawn through the liquid within the water reservoir as a series of small, smoke-filled bubbles. As these bubbles pass through the liquid, the liquid may filter water soluble and heavy particulates within the smoke, such as ash. The liquid may further transfer heat from the smoke-filled bubbles, cooling the smoke prior to its delivery to the user. Additionally, the liquid may add humidity to the smoke, decreasing drying effects from inhalation of smoke. Typically, the water reservoir may be filled with water, but the water may contain other elements such as flavoring or fragrant additives. Other liquids may be placed within the water reservoir, such as fruit juices, low alcohol beverages, and so on.

The receptacle 106*b* is typically formed in a conical or tapered shape. The receptacle 106*b* may define a tapered surface, conical surface, or conical section, as described herein. In this manner, the receptacle 106*b* may accommodate a variety of shapes and sizes of smoking or vaporizing article 180, which may include a various rolled products like a cigarette, cigar, cigarillo, and so on or a vaporizing article such as a vaporizer or vaporizer apparatus. For simplicity, the smoking or vaporizing article 180 is referred to herein as simply article 180. In an example embodiment, the receptacle 106*b* may accommodate an article 180 having a diameter ranging from four millimeters to fifteen millimeters. While the particular size and shape of the article 180 may vary, the article typically has an elongated shape that is tapered or angled at one end.

The receptacle 106*b* may be configured to receive the article 180. More specifically, the receptacle 106*b* may be configured to hold the article 180 and form a seal between the article 180 and the water filter 100*b*. The receptacle 106*b* may also be adapted to form a seal between the inner surface of the receptacle 106*b* and an article such as a vaporizer or a vaporizer apparatus. To facilitate retaining and sealing with an article, the receptacle may have a tapered or conical surface 107*b*. The tapered or conical surface 107*b* may define an internal conical angle θ (as measured as an interior angle along the conical surface). The conical angle θ may range between 5 and 20 degrees. In some instances, the conical angle θ may range between 10 and 15 degrees. In some instances, the conical angle θ may range between 5 and 10 degrees.

In some instances, the tapered or conical surface of the receptacle 106*b* may have a tapered or conical surface 107*b* having diameters that are particularly well suited to receive the article 180. For example, the receptacle 106*b* may define a tapered or conical surface 107*b* that defines a first internal diameter 131*b* at the opening or first end of the receptacle 106*b* and a second internal diameter 132*b* at an internal portion or second end of the receptacle 106*b* that is located inward of the opening (and proximate to the vessel body 102*b*). In some cases, the first diameter 131*b* ranges between 10 mm and 20 mm and the second diameter 132*b* is smaller than the first diameter and ranges between 2 mm and 9 mm. In some implementations, the first diameter ranges 131*b* between 12 mm and 16 mm and the second diameter 132*b* is smaller than the first diameter and ranges between 3 mm and 6 mm. The receptacle 106*b* may also have a length or distance 133*b* between the first and second end that ranges between 10 mm and 25 mm. In some cases, the length or distance 133*b* ranges between 10 mm and 30 mm.

Figure 7A:
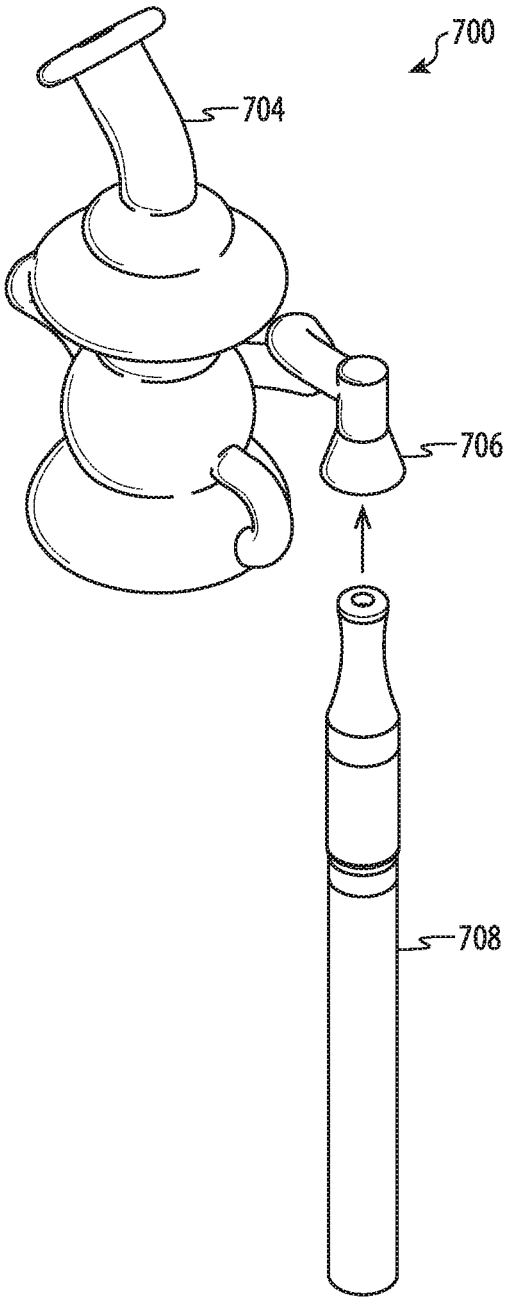
FIGS. 7A-7B depict another example of a water filter and vaporizing device.
Figure 7B:
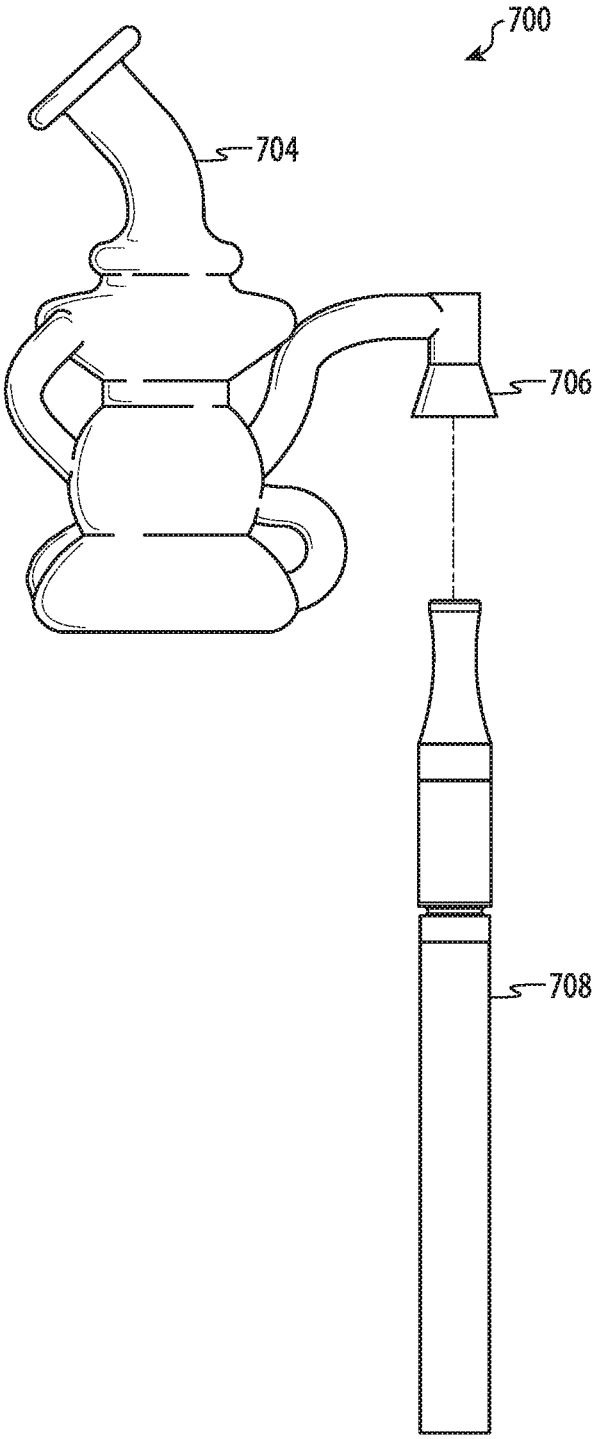

The receptacle 106*b* may be inclined or flat with respect to a supporting flat surface. In the present example the central axis of the receptacle 106 is substantially parallel to the base of the vessel body 102*b*. This may allow for comfortable use while limiting the amount of ash from falling into the water reservoir 102*b*. In some embodiments, the receptacle 106*b* may extend upward at an angle with respect to a flat surface that supports the water filter 100*b* when resting on the base. The receptacle 106*b* may in other embodiments be coupled to the vessel body 102*b* at another angle. FIGS. 7A-7B discussed below provide examples of an inverted or downward facing receptacle.

The seal between the article 180 and the receptacle 106*b* may be improved or facilitated by a surface treatment or surface finish of the receptacle 106*b*. For example, an inner surface 107*b* of the receptacle 106*b*, which may define at least a portion of the tapered or conical surface, may include surface features or a surface finish that facilitates forming a seal and retaining the article 180 within the receptacle 106*b*. In some examples, the inner surface 107*b* may have a surface texture (e.g., frosted, sandblasted, grooved). The inner surface 107*b* may additionally or alternatively be coated with a light adhesive or frictional material, such as rubber, urethane, or other substance having a higher coefficient of friction than the material of the receptacle 106*b*. In other examples, the inner surface 107*b* may be smooth or polished.

Figure 1C:
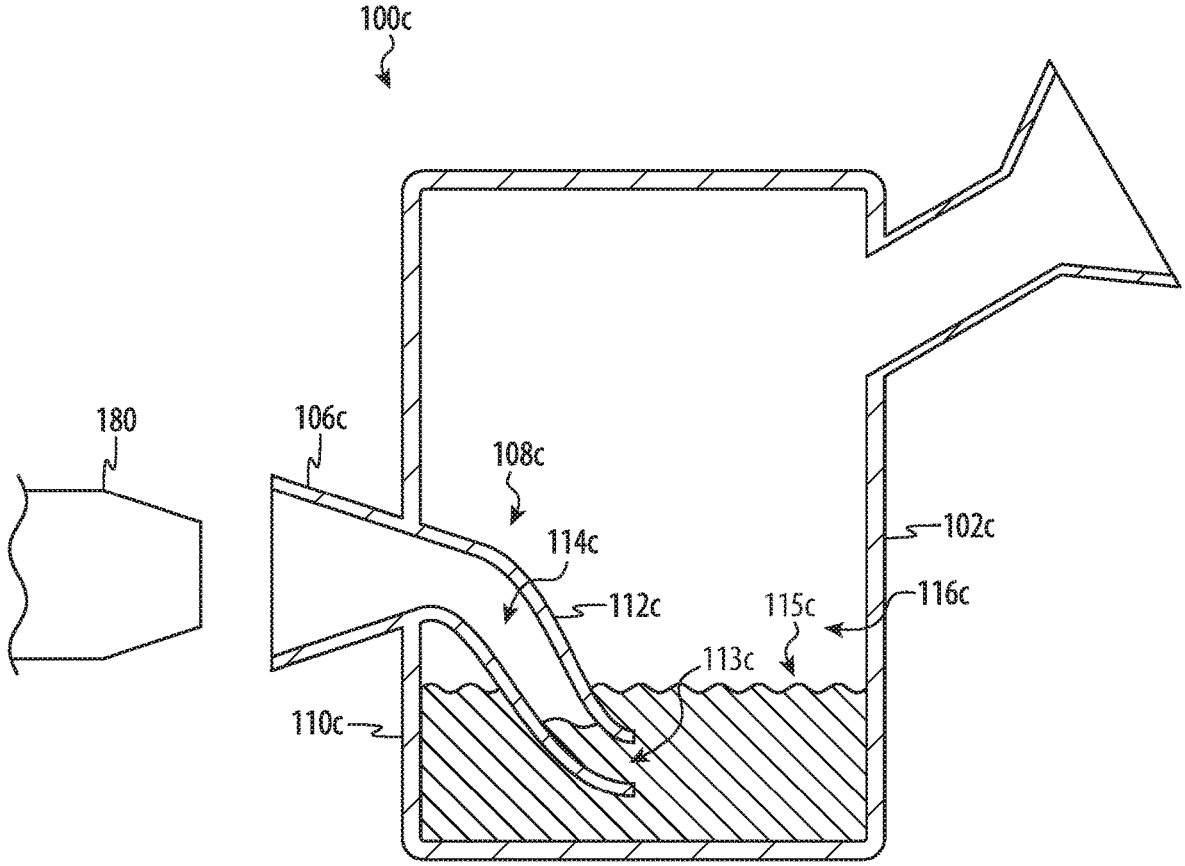
Figure 1D:
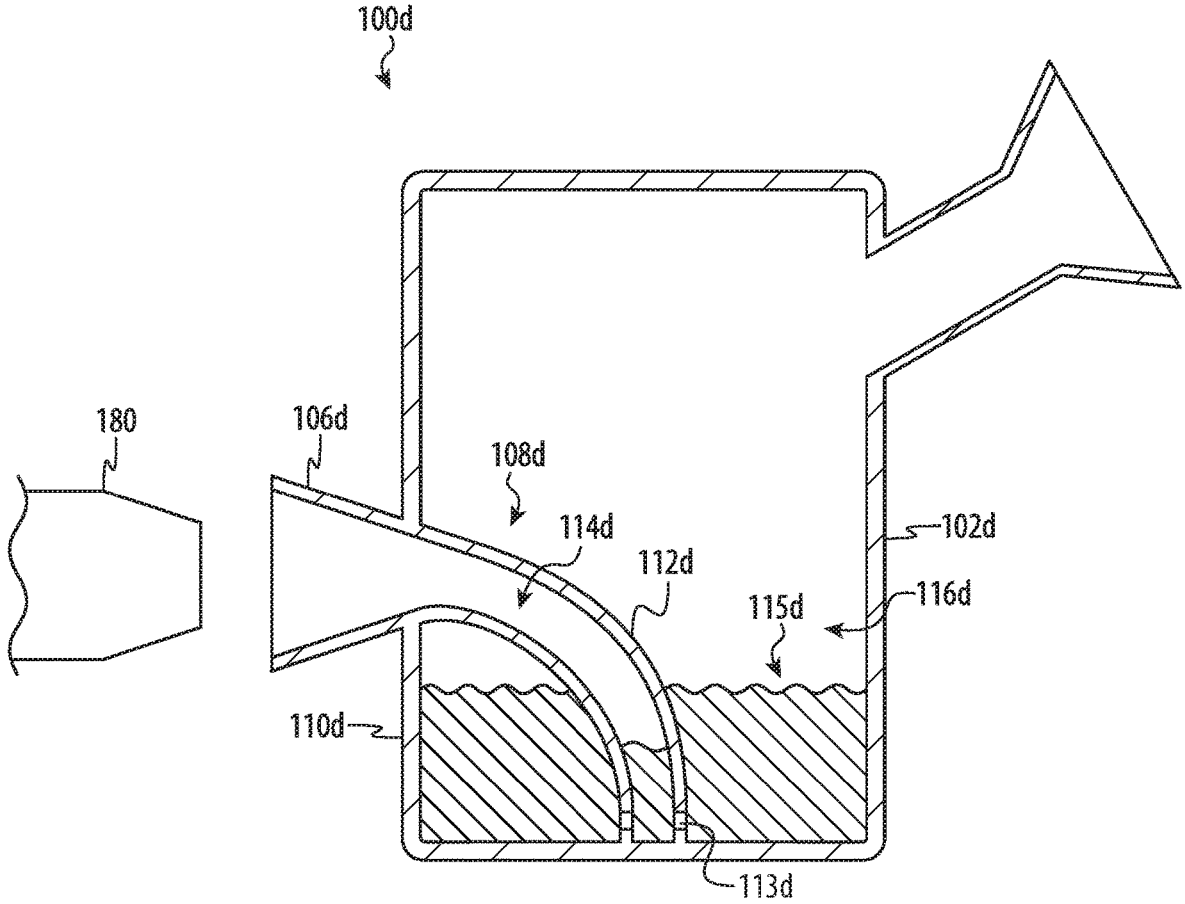
Figure 1E:
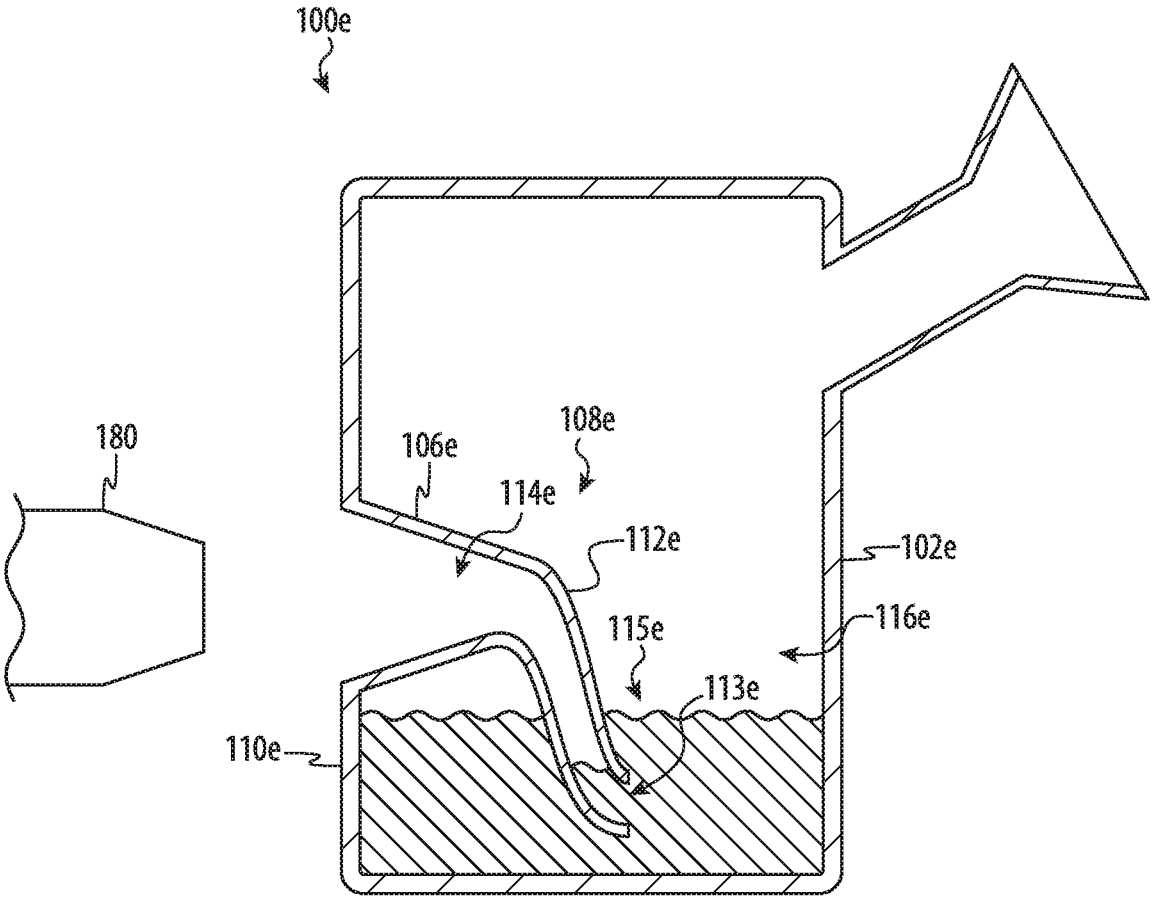

Generally, a downtube 108*b* is fluidically or operably coupled to the receptacle 106*b* such that a continuous path is provided from the article 180 (e.g., rolled product or vaporizer) into the receptacle 106*b*, through an outer wall 110*b* of the vessel body 102*b*, and into a lower portion of the water reservoir 116*b*. The downtube 108*b* may be formed integral with the vessel body 102*b* as shown, with the outer wall 110*b* of the vessel body 102*b* and a channel 112*b* or defining a chamber 114*b* or passage through which smoke passes into the water reservoir 116*b*. The channel 112*b* may be shaped as a partial cylinder molded into or otherwise coupled to the outer wall 110*b*. In some embodiments, the downtube may extend into the reservoir 116*b* and downward at an angle from the outer wall 110*b* (e.g., sidewall) of the vessel body 102*b*. FIGS. 1C-1E depict various examples of a downtube that extends into the reservoir.

The downtube 108*b* typically forms a passage or chamber 114*b* extending to a bottom surface of the water reservoir 116*b*. In operation, the water reservoir 116*b* is partially filled with a liquid such that the water level 115*b* is between 1 mm and 20 mm above the outlet 113*b* of the downtube 108*b*. As the article 180 coupled to the receptacle 106*b* is combusted or vaporized, the chamber 114*b* fills with smoke, and smoke may begin to pass through the liquid and into the portion of the water reservoir 116*b* above the water level 115*b* (e.g., an upper portion of the water reservoir). A user may further create negative pressure within the water reservoir 116*b* (e.g., by drawing air through the mouthpiece 104) to increase the transfer of smoke from the chamber 114*b* into the water reservoir 116*b*.

The mouthpiece 104*b* is generally positioned on an upper portion of the vessel body 102*b*, above the typical water level 115*b*. Accordingly, the mouthpiece 104*b* is typically positioned at least 5 mm above the outlet 113*b* of the downtube 108*b*. The mouthpiece 104*b* forms another opening through the vessel body 102*b* and into the water reservoir 116*b*. As smoke enters the upper portion of the water reservoir 116*b*, the smoke may be drawn from the water reservoir 116*b* through the mouthpiece 104*b* and inhaled by a user. Frequently, smoke accumulates within the upper portion of the water reservoir 116*b* for a short time prior to inhalation, which may further dissipate heat from the smoke.

FIG. 1C depicts another example cross-sectional view of a water filter 100*c*, which may correspond to the water filter 100*a* of FIG. 1A. As shown in FIG. 1C the downtube 108*c* is formed integral to (or integrally formed with) the vessel body 102*c* and extends inward from the outer wall 100*c* and into the chamber 116*c*. In the present example, the internal chamber 114*c* of the downtube 108*c* may be formed from a cylindrical or tube-shaped channel 112*c* that may be defined, as least in part, by the outer wall 110*c* of the vessel body 102*c*. Specifically, a portion of the internal chamber 114*c* that is located at the base of the receptacle 106*c* and within the outer wall 110*c* is defined, in part, by that portion of the outer wall 110*c*.

The downtube 108*c* depicted in FIG. 1C forms a continuous path from the receptacle 106*c* to some portion of the water reservoir 116*c*. In this example, the downtube 108*c* extends inward into the water reservoir 116*c*. The outlet 113*c* or port of the downtube 108*c* is positioned below a typical water level 115*c*, delivering smoke through a liquid and into the upper portion of the water reservoir 116*c*. Furthermore, similar to as described above with respect to FIG. 1B, the water filter 100*c* of FIG. 1C includes a receptacle 106*c* that is configured to receive an article 180 and may include one or more of the features described above including a specially configured tapered or conical surface including the various surface treatments described with respect to other embodiments. Also, similar to the previous examples, one or all of the various elements of the water filter 100*f* may be integrally formed to define a single monolithic piece.

FIG. 1D depicts another example cross-sectional view of a water filter 100*d*, which may correspond to the water filter 100*a* of FIG. 1A. Similar to as described above with respect to FIG. 1B, the water filter 100*d* of FIG. 1D includes a receptacle 106*d* that is configured to receive an article 180 and may include one or more of the features described above including a specially configured tapered or conical surface. Similar to the previous examples, one or all of the various elements of the water filter 100*d* may be integrally formed to define a single monolithic piece.

In the example of FIG. 1D, the downtube 108*d* is formed integral to (or integrally formed with) the vessel body 102*d*. In the present example, the internal chamber 114*d* of the downtube 108*d* may be formed from a cylindrical or tube-shaped channel 112*d* that may be defined, as least in part, by the outer wall 110*d* of the vessel body 102*d*. In particular, the downtube 108*b* defines an internal chamber 1114*d* that has an end that is defined, at least in part, by an inner surface of the outer wall 110*d* located along the base of the vessel body 102*d*. Similar to the previous example, a portion of the internal chamber 114*d* that is located at the base of the receptacle 106*d* and within the outer wall 110*d* is also defined, in part, by the respective portion of the outer wall 110*d*.

The downtube 108*d* depicted in FIG. 1D forms a continuous path from the receptacle 106*d* to some portion of the water reservoir 116*d*. In this example, the downtube 108*d* extends inward into the water reservoir 116*d*. The downtube 108*d* includes one or more outlets 113*d* or ports that are positioned below a typical water level 115*d*, delivering smoke through a liquid and into the upper portion of the water reservoir 116*d*. As shown in FIG. 1D, the downtube 108*d* extends inward to meet the inner surface of the outer wall 110*d* along a bottom region of the reservoir 116*d*. In some cases, a seam, joint, or other type of interface is defined where the downtube 108*b* meets the inner surface of the outer wall 110*d*. The seam or joint may appear as and/or function as a continuous piece of material when the lower portion of the downtube 108*d* is integrally formed with the lower portion of the outer wall 110*d*. The downtube 108*d* may be welded, melted, fused, or otherwise joined with the outer wall 110*d* to define a single monolithic piece. In some embodiments, an array of two or more outlets 113*d* are formed proximate to or along the seam. The location of the array of two or more outlets 113*d* may also be described as being proximate to an inner surface of the outer wall 110*d*.

The outlet configuration of FIG. 1D may have several benefits. For example, by integrally forming the end or lower region of the downtube 108*d* with the outer wall 110*d*, the strength and mechanical integrity of the downtube 108*d* may be improved. Furthermore, locating multiple small outlets 113*d* proximate to the seam or the lower portion of the outer wall 110*d* may increase the cooling and filtering performance of water filter 100*d*. For example, multiple small outlets 113*d* decrease the size of the bubble while also increasing the number or amount of bubbles, which may improve filtering and/or cooling effects provided by the liquid held in the chamber 116*d*. This effect may also be referred to as a percolating effect or simply a percolator.

FIG. 1E depicts another example cross-sectional view of a water filter 100*e*. In the example of FIG. 1E, the receptacle 106*e* is still integrally formed with the vessel body 102*e*. However, the receptacle 106*e* extends inward from the outer wall 110*e* and into the water reservoir 116*c*. The receptacle 106*e* may be described as being recessed or at least partially recessed into the vessel body 102*e*. In the example of FIG. 1E, the receptacle 106*e* does not extend outward from the vessel body 102*e* and has an outlet or outer edge that is flush or substantially flush with an exterior surface of the outer wall 110*e* of the vessel body 102. However, in other embodiments, the receptacle 106*e* may protrude or may be proud of the exterior surface of the outer wall 110*e*.

While the receptacle 106*e* is recessed into the vessel body 102*e* in the present example, similar to as described above with respect to FIG. 1B, the receptacle 106*e* is configured to receive an article 180 and may include one or more of the features described above including a specially configured tapered or conical surface and the various surface treatments described with respect to other embodiments. Similar to the previous examples, one or all of the various elements of the water filter 100*f* may be integrally formed to define a single monolithic piece.

As shown in FIG. 1E the downtube 108*e* is formed integral to (or integrally formed with) the vessel body 102*e* and extends inward from the receptacle 106*e* and into the chamber 116*e*. In the present example, the internal chamber 114*e* of the downtube 108*e* may be formed from a cylindrical or tube-shaped channel 112*e*. Various other shapes and cross-sectional profiles are also possible. Similar to other examples, the outlet 113*e* or port of the downtube 108*e* is positioned below a typical water level 115*e*, delivering smoke through a liquid and into the upper portion of the water reservoir 116*e*.

Figure 1F:
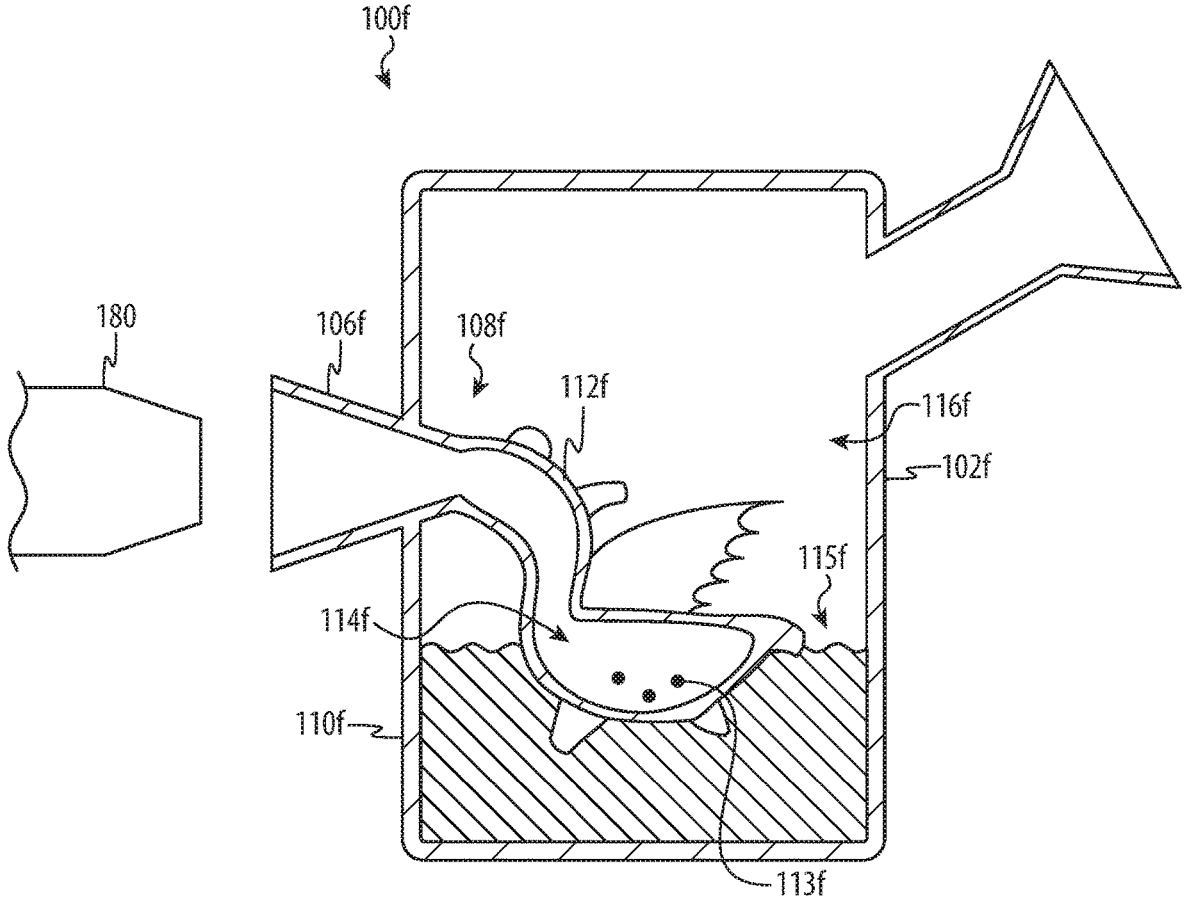

FIG. 1F depicts another example cross-sectional view of a water filter 100*f*, which may correspond to the water filter 100*a* of FIG. 1A. Similar to as described above with respect to FIG. 1B, the water filter 100*f* of FIG. 1F includes a receptacle 106*f* that is configured to receive an article 180 and may include one or more of the features described above including a specially configured tapered or conical surface and may include one or more of the surface treatments or surface features described with respect to other embodiments herein. Similar to the previous examples, one or all of the various elements of the water filter 100*f* may be integrally formed to define a single monolithic piece.

In the example of FIG. 1F, the downtube 108*f* is formed integral to (or integrally formed with) the vessel body 102*f*. However, in this example, the downtube 108*f* is formed within a decorative figurine 112*f*, which defines an internal chamber 114*f*. Here, the decorative figurine 112*f* resembles a dragon character in which the mouth of the dragon is integrally formed with or otherwise attached to the outer wall 110*f* of the vessel body 102*f*. While the figurine 112*f* is depicted as a dragon, the figurine could be another complex three-dimensional contoured shape that resembles another type of character or object. It is not necessary that the figurine 112*f* resemble a person, animal, or mythical character, but the figurine 112*f* typically represents some object or form not specifically tied to the function of the downtube 108*f*. The figurine 112*f* of FIG. 1F may be contrasted with respect to some of the other examples described above as having a non-uniform or varying cross section which may expand and narrow in accordance with the complex three-dimensional contoured shape of the figurine.

The downtube 108*f* depicted in FIG. 1F forms a continuous path from the receptacle 106*f* to the water reservoir 116*f*. The downtube 108*f* is formed by a figurine 112*f* that includes one or more outlets 113*f* or ports that are positioned below a typical water level 115*f*, delivering smoke through a liquid and into the upper portion of the water reservoir 116*f*. In the present example, the outlets 113*f* are positioned along a lower surface of the figurine 112*f*. Specifically, multiple outlets are defined along the belly of the figurine 112*f* which, in this case, resembles a small dragon character. Similar the example of FIG. 1D, locating multiple small outlets 113*f* within the liquid may increase the cooling and filtering performance of water filter 100*f*. For example, multiple small outlets 113*f* decrease the size of the bubble while also increasing the number or amount of bubbles, which may improve filtering and/or cooling effects provided by the liquid held in the chamber 116*f*.

Figure 2A:
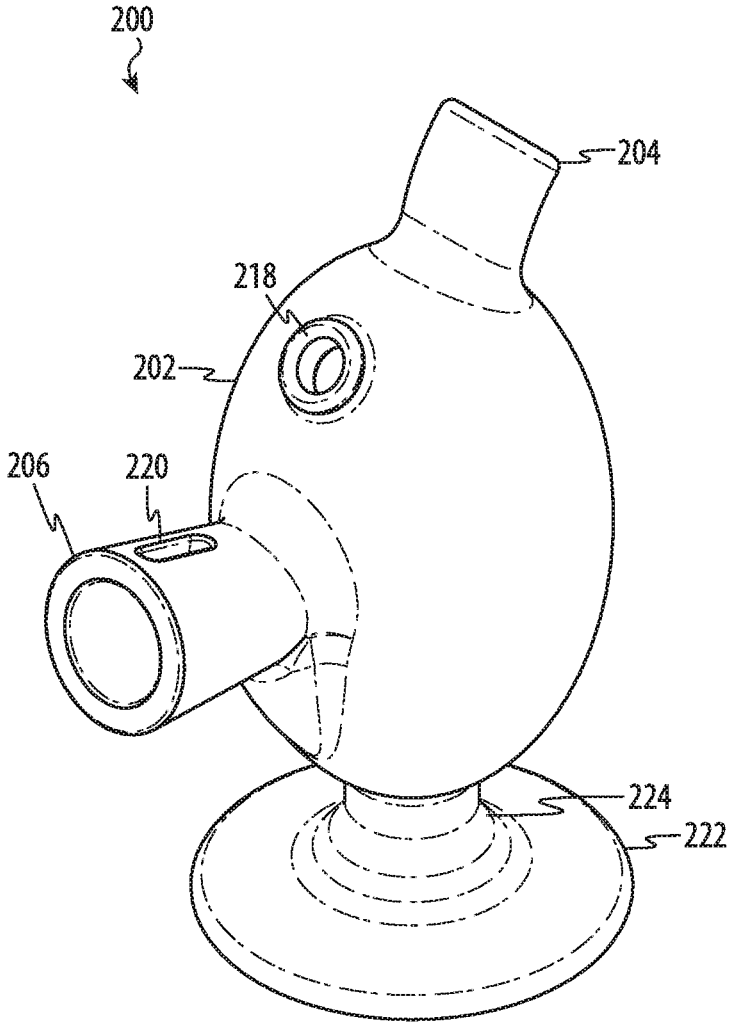
FIG. 2A depicts a second example of a water filter, having an ellipsoid vessel body.
Figure 2B:
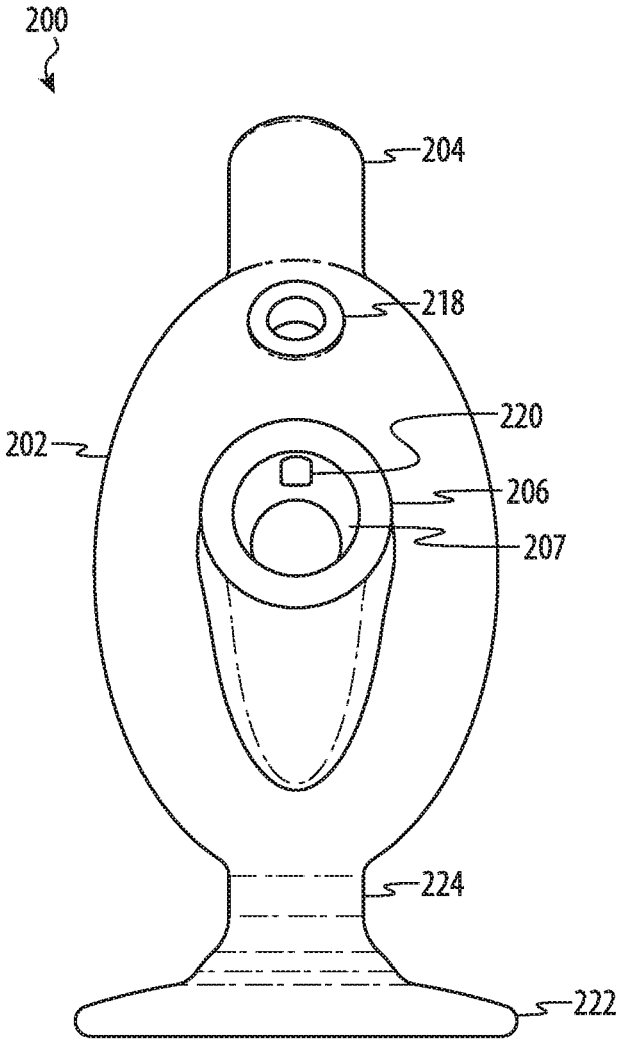
FIG. 2B depicts a front view of the water filter of FIG. 2A.
Figure 2C:
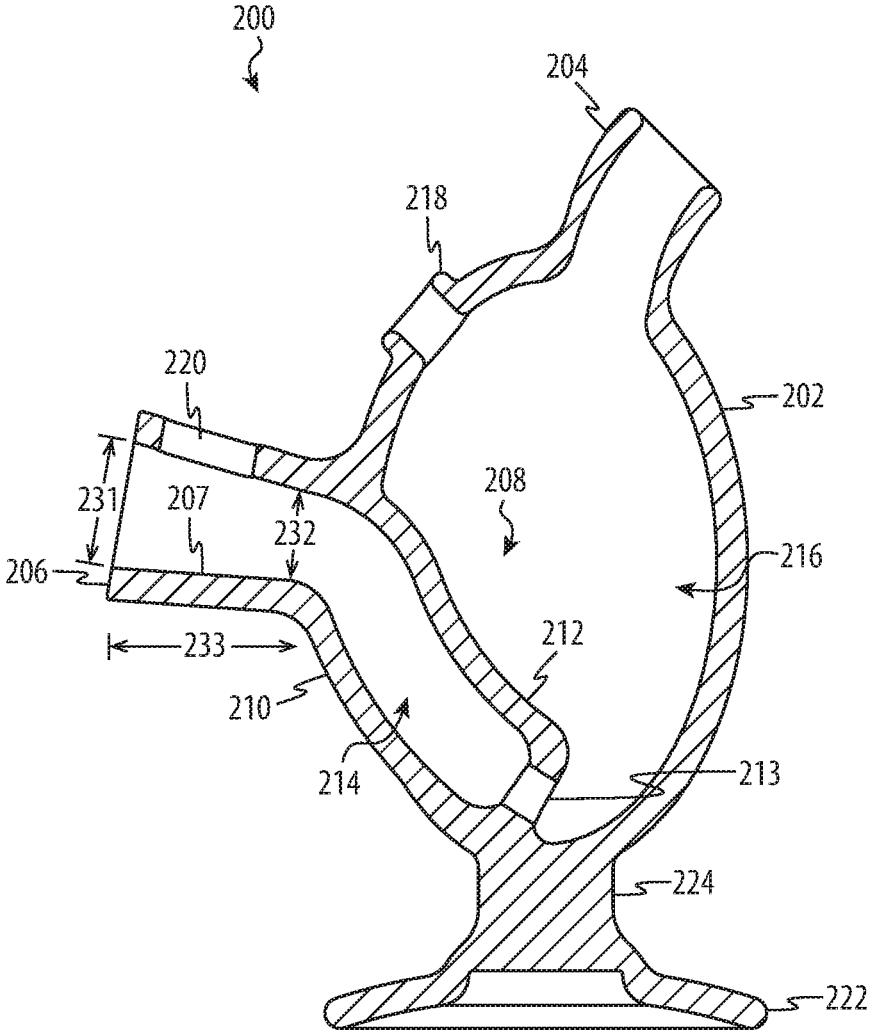
FIG. 2C depicts a cross-sectional view of the water filter of FIG. 2A.

FIGS. 2A-2C depict another example of a water filter according to the present disclosure. The water filter 200 includes a vessel body 202 having an ellipsoid shape. A receptacle 206 and a mouthpiece 204 are coupled to the vessel body 202. As described with respect to FIG. 1A-1C, the various components of the water filter 200 may be formed from an appropriate material, such as glass or plastic. Generally, the components of the water filter 200 are formed as a single, monolithic, or unitary body, though this is not necessary.

The mouthpiece 204 may be formed in a variety of shapes. For example, FIGS. 2A-2C depict the mouthpiece 204 as a tubular protrusion formed at a non-perpendicular angle near the top of the vessel body 202. In other embodiments, the mouthpiece 204 may be formed as an opening in the vessel body 202, as a flanged opening, as a tube having a flared end, or in another shape which may facilitate placement on or within a user's mouth. The mouthpiece 204 may be angled or curved, or may be placed perpendicular to the top or another surface of the vessel body 202 (such as depicted with respect to FIG. 5).

In some embodiments, the water filter 200 includes a carburation port 218. The carburation port 218 may define an opening or aperture within the vessel body 202 positioned on an upper portion of the vessel body 202 such that the carburation port 218 is above a typical water level (e.g., at least 5 mm above the outlet 213 of the downtube 208) within the reservoir 216. During operation of the water filter 202, the carburation port 218 facilitates clearing or harvesting the smoke within the water reservoir 216 by providing a source for fresh air to enter the vessel body 202 into the water reservoir 216.

The carburation port 218 may be sized and shaped to allow it to be covered or sealed by a user's finger (e.g., an index finger). In some cases, the carburation port 218 is configured to be blocked by a user's finger when the water filter 200 is held in the user's hand. For example, a user may generally place a finger over the carburation port 218 to form a sealed path from the receptacle 206, through the water reservoir 216, and out through the mouthpiece 204. With this path sealed, the user may draw smoke into the water reservoir 216 by creating negative pressure within the upper portion of the water reservoir 216. Once the water reservoir 216 fills with smoke, the user may remove the finger from the carburation port 218, allowing the user to draw substantially all the smoke out of the water reservoir 216. During this process, the carburation port 218 allows the smoke to be replaced with fresh air from outside the water filter 200.

Accordingly, the carburation port 218 may be a round opening with a diameter between 2 mm and 15 mm. The carburation port 218 may be positioned such that a user's finger (e.g., an index finger) naturally rests on or near the carburation port 218 when the water filter 200 is held. In the present example, the carburation port 218 is positioned above the receptacle 206, which facilitates use of a user's index finger to operate the carburation port 218 while holding the water filter 200 with one hand. The carburation port 218 may be positioned above the receptacle 206 by a distance that is less than 20 mm. In some cases, the carburation port 218 is positioned within 15 mm or less from the receptacle 206. In some cases, the carburation port 218 is positioned at least 5 mm from the receptacle 206. In some cases, the carburation port is positioned so that it is blocked by one of two fingers that hold the water filter 200 by the receptacle 206 (similar to a traditional cigarette grip).

As depicted, the carburation port 218 may also include a raised flange to better facilitate a seal with an object, such as a user's finger. In some embodiments, the opening may be another shape, such as an oval, square, triangle, or another geometric shape. In some embodiments, the opening may be configured to mate with another object, such as a plug in lieu of a user's finger, in order to create a seal.

In some embodiments, the water filter 200 may further include a standing base 222, to facilitate placing the water filter 200 on a surface. The standing base 222 may be coupled to the vessel body 202 via a stem 224. In many embodiments, the standing base 222 and stem 224 are formed of the same material as the vessel body 202, and may be formed integrally with the vessel body 202. In other embodiments, the standing base 222 and/or stem 224 may be separable from the vessel body 202, and may additionally be formed from another appropriate material (e.g., glass, silicone, plastic, metal, ceramic, wood, and so on).

Turning to FIG. 2B, a front view of the water filter of FIG. 2A is depicted. The water filter 200 includes a receptacle 206 coupled to the vessel body 202, which receptacle 206 may be similar to the receptacle 106 depicted with respect to FIGS. 1A-1F. The receptacle 206 is typically formed in a conical shape to accommodate a smoking or vaporizing article (e.g., a rolled product or vaporizer) having a variety of shapes and sizes.

In some instances, the tapered or conical surface of the receptacle 206 may have a tapered or conical surface 207 having diameters that are particularly well suited to receive the smoking or vaporizing article. For example, the receptacle 206 may define a tapered or conical surface 207 that defines a first internal diameter 231 at the opening or first end of the receptacle 206 and a second internal diameter 232 at an internal portion or second end of the receptacle 106. The internal portion or second end of the receptacle may be located inward of the opening (and proximate to the vessel body 202). In some cases, the first diameter ranges between 10 mm and 20 mm and the second diameter is smaller than the first diameter and ranges between 2 mm and 9 mm. In some implementations, the first diameter ranges between 12 mm and 16 mm and the second diameter is smaller than the first diameter and ranges between 3 mm and 6 mm. The receptacle 206 may also have a length or distance 233 between the first and second end that ranges between 10 mm and 30 mm. In some cases, the length or distance 233 ranges between 15 mm and 25 mm.

As discussed above, the inner surface 207 may include features to facilitate retaining a cigarette, vaporizer, or other article within the receptacle 206 and/or forming a seal between the article and the receptacle 206. For example, the inner surface 207 may be textured or coated with a material which increases friction between the receptacle 206 and an article. In some cases, the inner surface 207 includes grooves or a bead blasted or textured finish to provide a suitable interface between the receptacle 206 and an article.

In some embodiments, the receptacle 206 may be formed with a cleaning port 220. As a cigarette is combusted, ash and other debris and particulates may accumulate within the receptacle 206, the downtube 208, and/or the water reservoir. The cleaning port 220 may accommodate the insertion of cleaning implements to clear the receptacle 206, the downtube 208, and/or the water reservoir of debris.

Turning to FIG. 2C, a cross sectional view of the water filter in FIG. 2A is depicted. Similar to the embodiment describe above with respect to FIG. 1B, the vessel body 202 forms a water reservoir 216. The vessel body 202 is formed by an outer wall 210. Smoke enters the water reservoir through the receptacle 206, through a downtube 208, and into a lower portion of the water reservoir 216. A user typically partially fills the water reservoir 216 with a liquid to a point above the outlet 213 of the downtube 208, but well below the mouthpiece 204 and the carburation port 218. Smoke or vapor may accumulate in the portion of the water reservoir 216 above the liquid.

Generally, a downtube 208 couples to the receptacle 206 such that a continuous path is provided from the cigarette or other article into the receptacle 206, through the outer wall 210 of the vessel body 202, and into a lower portion of the water reservoir 216. In many embodiments, the downtube 208 may be formed integral with the vessel body 202, with the outer wall 210 of the vessel body and a channel 212 coupled to the outer wall 210 defining a chamber 214 through which smoke passes into the water reservoir 216. In some embodiments, the downtube 208 may not be formed with the outer wall 210, but may instead be formed from a cylindrical channel which protrudes into the water reservoir 216 (similar to the downtube 108*c* depicted with respect to FIG. 1C).

The downtube 208 extends near a bottom surface of the water reservoir 216, such that the outlet 213 of the downtube 208 would be below a typical water level during operation of the water filter 200. The downtube 208 may deliver smoke under the surface of the liquid in the water reservoir in a manner similar to that described above with respect to FIG. 1B.

Figure 3:
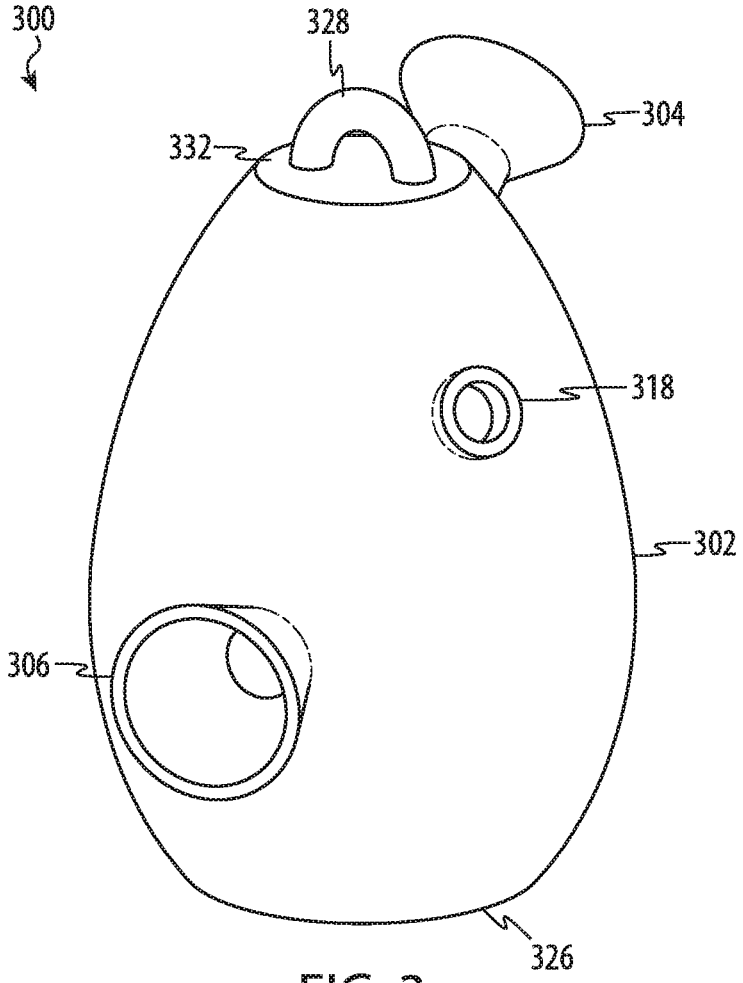
FIG. 3 depicts another example of a water filter, having a pear-shaped vessel body.

As FIGS. 3-6C illustrate, a water filter according to the present disclosure may have a variety of geometric shapes and features. For example, FIG. 3 depicts a third example of a water filter according to the present disclosure. The water filter 300 includes a vessel body 302 having a pear shape. The pear-shaped vessel body 302 may be partially ellipsoid with a larger diameter lower portion. The pear-shaped vessel body 302 may also have a flattened bottom surface 326, such that a standing base may be omitted.

The water filter 300 further includes a receptacle 306 and a mouthpiece 304 coupled to the vessel body 302, providing a path for smoke to pass from a cigarette, vaporizer, or other article, into the receptacle 306, through the vessel body 302, and out through the mouthpiece 304. The receptacle 306 may be similar to the receptacles 106, 206 as described above with respect to FIGS. 1A-2C. The receptacle 306 may alternatively be shaped differently, such as a tubular shape or a combination of a tube and a cone to accommodate various sizes and shapes of smoking or vaporizing articles.

The water filter 300 may further include a carburation port 318 in the vessel body 302. Where the carburation port 218 depicted in FIGS. 2A-2C was positioned directly above the receptacle 206, the carburation port 318 may be positioned in other locations, such as illustrated in FIG. 3. The carburation port 318 may be positioned above a typical water level (e.g., at least 5 mm above the smoke outlet from the receptacle 306) in a location at or near where a typical user may place a finger while holding the water filter 300.

In many embodiments, the water filter 300 is small enough to fit into a user's hand or otherwise be easily transported. In these and other embodiments, the water filter 300 may include an attachment point, such as an eyelet 328, for attachment to a necklace, bracelet, keychain, or other object for ease of carrying. In some embodiments, the eyelet 328 may be attached to a top surface 332 of the vessel body 302, while in other embodiments the eyelet 328 may be attached at a different location. In some embodiments, the attachment point may be a rod, bar, hook, or similar feature to facilitate carrying or attachment to another object.

Figure 4:
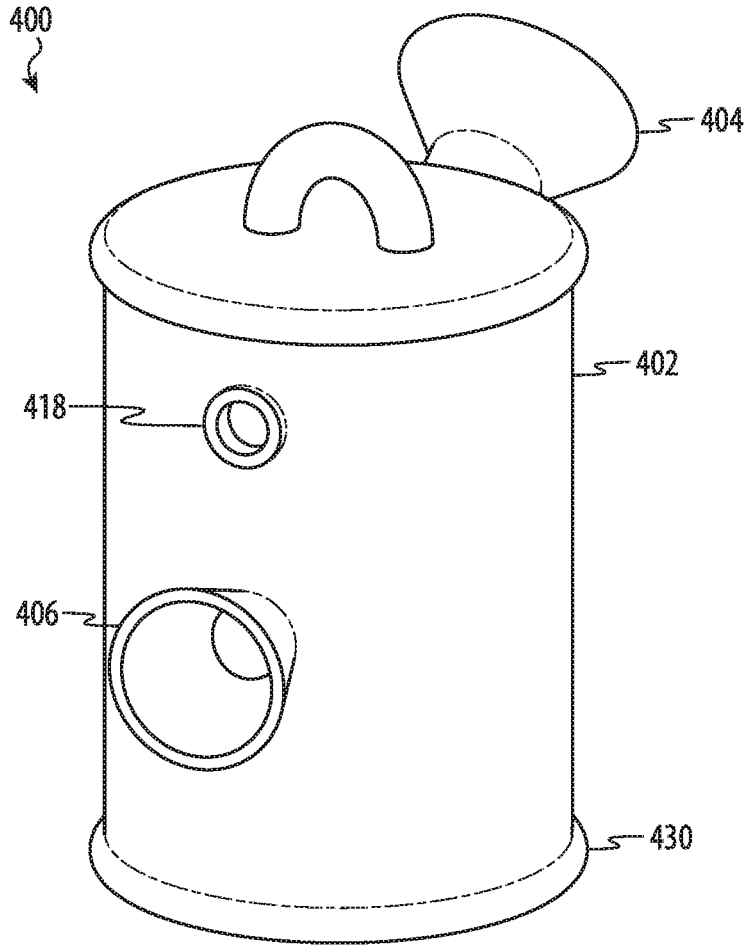
FIG. 4 depicts another example of a water filter, having a barrel or cylindrical-shaped vessel body.

FIG. 4 depicts a fourth example of a water filter according to the present disclosure. The water filter 400 includes a vessel body 402, with a receptacle 406 and a mouthpiece 404 coupled to the vessel body 402. The vessel body 402 may be shaped as a cylinder or barrel. The barrel-shaped vessel body 402 may further include decorative features 430. In some embodiments, such decorative features 430 may be omitted. Embodiments having other vessel body shapes may also include decorative features 430.

The water filter 400 may include some or all of the features and functions described above with respect to FIGS. 1A-3. For example, the receptacle 406 may hold a smoking or vaporizing article (e.g., a cigarette or vaporizer) and smoke or vapor from the article may be delivered into the vessel body 402 and out through the mouthpiece 404. A carburation port 418 may facilitate clearing smoke or vapor accumulated in the vessel body 402.

Figure 5:
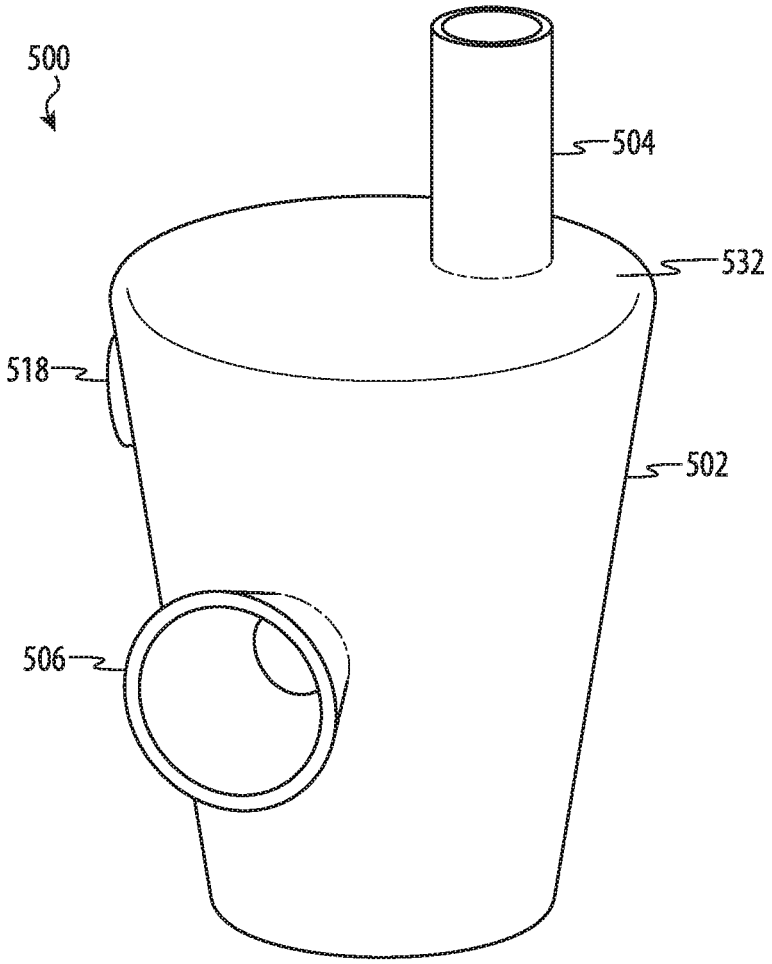
FIG. 5 depicts another example of a water filter, having a conical frustum-shaped body.

FIG. 5 depicts a fifth example of a water filter according to the present disclosure. The water filter 500 includes a vessel body 502, with a receptacle 506 and a mouthpiece 504 coupled to the vessel body 502. The vessel body 502 may be shaped as a conical frustum, having a diameter which changes along its length, similar to many ceramic pots.

The water filter 500 may include some or all of the features and functions described above with respect to FIGS. 1A-4. For example, the receptacle 506 may hold a rolled cigarette, vaporizer, or other article and smoke or vapor from the cigarette may be delivered into the vessel body 502 and out through the mouthpiece 504. As depicted, the mouthpiece may be formed as a long cylinder coupled perpendicular to a top surface 532 of the vessel body 502. A carburation port 518 may facilitate clearing smoke or vapor accumulated in the vessel body 502.

Figure 6A:
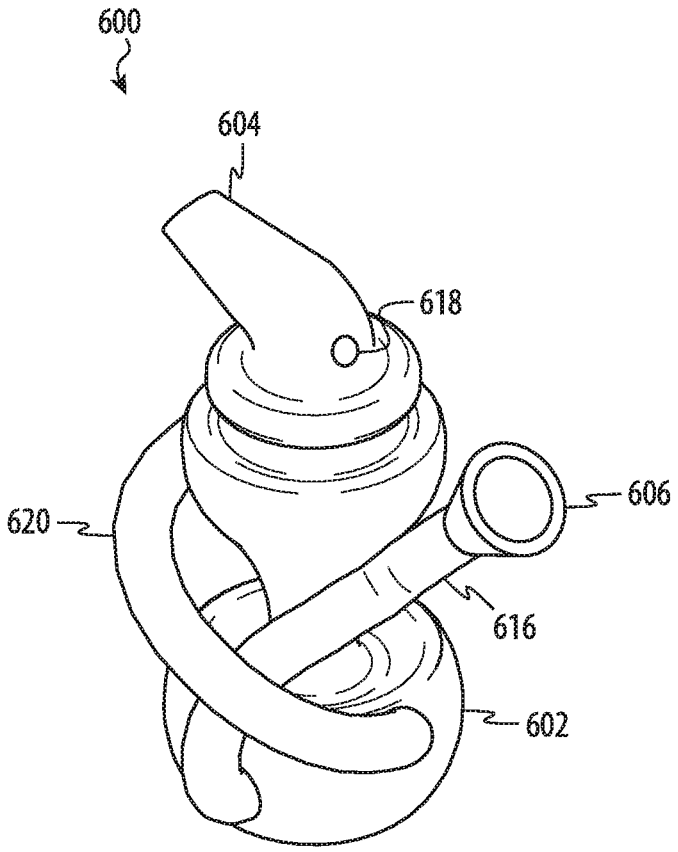
FIGS. 6A-6C depict another example of a water filter having an alternative receptacle configuration.
Figure 6B:
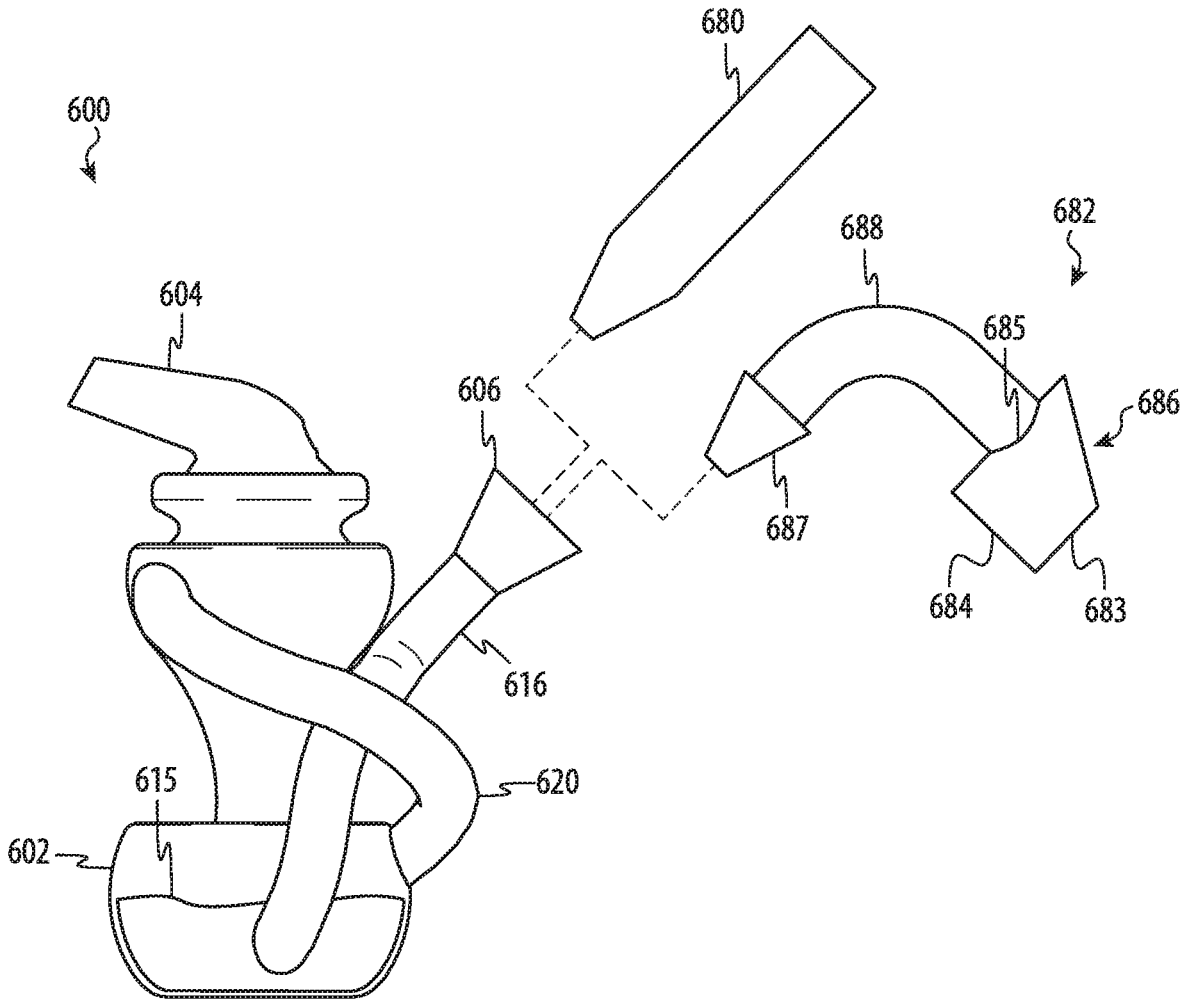
Figure 6C:
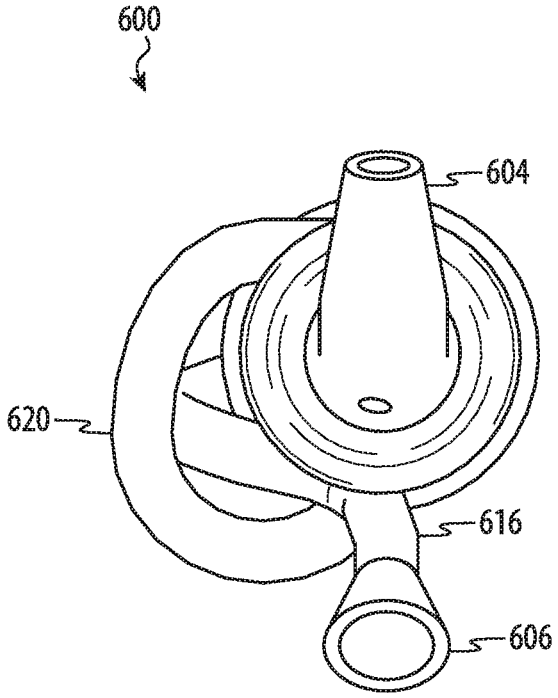

FIGS. 6A-6C depict another example of a water filter according to the present disclosure. The water filter 600 includes a vessel body 602, with a receptacle 606 and a mouthpiece 604 coupled to the vessel body 602. The vessel body 602 also defines a carburation port 618 positioned along an upper portion of the vessel body 602. The vessel body 602 may have a stylistic shape with a contoured surface that resembles a hat or other object. The vessel body 602 defines lower and upper cavities that may be separated by a wall or section or may be coupled by an open section or chamber.

In this example, the vessel body 602 is integrally formed with a first tube 616 that couples the receptacle 606 to the internal cavity (e.g., the lower cavity) of the vessel body 602. The vessel body 602 is also integrally formed with a second tube 620 that couples a lower portion or the lower cavity of the vessel body 602 with an upper portion or the upper cavity of the vessel body 602. As shown in FIGS. 6A-6C, the first tube 616 and the second tube 620 may twist around the vessel body 602 and intertwine with each other.

As shown in FIG. 6B, the first tube 616 extends and twists from a front region of the water filter 600 to a side of the vessel body 602. The second tube 620 extends and twists from a front of the lower portion of the vessel body 602 to a side of the upper portion of the vessel body 602. Also as shown in FIG. 6B, the first tube 616 couples to the lower portion of the vessel body 602 to define an outlet that is configured to be submerged below the water reservoir 615. The second tube 620 couples to the lower portion of the vessel body 602 to define an inlet that is configured to be above the water reservoir 615. This inlet and outlet configuration, in combination with the twisted configuration of the first tube 616 and the second tube 620 helps prevent liquid from the water reservoir 615 from being spilled when the water filter 600 is tipped or handled.

As shown in FIG. 6B, the receptacle 606 of the water filter 600 may be configured to receive a smoking or vaporizing article 680. As described with respect to the other embodiments described herein, the receptacle 606 may define a conical or tapered surface that is configured to form a seal between the smoking or vaporizing article 680 and the receptacle 606. Also as shown in FIG. 6B, the receptacle 606 may be configured to receive an accessory 682. The accessory 682 may be configured to receive a combustible product and or a vaporizing oil or other solid or liquid product.

In some cases, the accessory 682 is configured to receive a combustible leaf product like leaf tobacco. The accessory 682 may also be configured to receive a product that is able to be vaporized and/or partially combusted when heated in the accessory 682.

In the example of FIG. 6B, the accessory 682 is a vaporizer bucket, which may also be referred to as a vaporizer apparatus. The vaporizer bucket 682 may be configured to receive heat from an external source in order to vaporize a product held within an open cavity. The product may include a liquid product which may include, without limitation, one or more of: an oil, an extract, a solution, a concentrate or a mixture. The product may also be a solid or gel form that is vaporized and/or partially combusted in response to an external heat source. In some cases, the product may be a powdered solid, a crystalline solid, or other form of solid product.

As shown in FIG. 6B, the vaporizer bucket 682 includes a flat lower surface 684 that is surrounded by a (cylindrical) wall 683. While FIG. 6B depicts a rounded or cylindrical wall, it is not necessary that the wall 683 be cylindrical or rounded in shape and other variations are possible. The flat lower surface 684 is configured to vaporize and/or partially combust the product (whether in liquid, solid, or gel form). The flat lower surface 684 is configured to vaporize and/or combust the product in response to receiving heat from an external source, such as a flame, torch or other heating element. The vaporizer bucket 682 also has an outlet 685 defined along an upper portion of the (cylindrical) wall 683. The outlet 685 is configured to receive the vaporized product and route the vaporized product to a conical protrusion 687 through a hollow tube 688. In particular, the vaporized product may be drawn through the tube 688 to the conical protrusion when the user inhales on the water filter 600, which results in a small vacuum being created at the receptacle 606.

As shown in FIG. 6B, the accessory 682 includes a tapered protrusion 687 that is configured to form a seal with a conical internal surface of the receptacle 606. In some embodiments, the taper or angle of the tapered protrusion 687 corresponds to or is substantially similar to an internal angle or interior taper of the conical internal surface of the receptacle. In some embodiments, the conical internal surface and/or the outer surface of the tapered protrusion 687 are sand blasted or otherwise treated to have a surface finish that facilitates the seal between the two components. While this interface is described with respect to the embodiment depicted in FIG. 6B, a similar design or approach may be applied to any of the tapered receptacle embodiments described herein.

While the accessory 682 is depicted as a vaporizer bucket in FIG. 6B, other types of smoking or vaporizing accessories or articles may also be used. For example, the water filter 600 may be configured to be used with a hand-held vaporizer (see, e.g., vaporizing apparatus 708 of FIGS. 7A-7B) or another article or apparatus that is configured to produce a combusted and/or vaporized product. In some implementations, the receptacle 606, and the tapered or conical surface of the receptacle, may be configured to receive and form a partial seal with one or more of these other types of accessories.

The water filter 600 may include some or all of the features and functions described above with respect to FIGS. 1A-5. For example, the receptacle 606 may hold a rolled cigarette and smoke from the cigarette may be delivered into the vessel body 602 and out through the mouthpiece 604. As depicted, the mouthpiece may be formed as a contoured shape that extends from an upper portion of the vessel body 602. A carburation port 618 may facilitate clearing smoke accumulated in the vessel body 602.

FIGS. 7A-7B depict another example water filter 700 in accordance with embodiments described herein. Similar to other examples described above, the water filter 700 includes a mouthpiece 704 and a receptacle 706 that may be integrally formed with a vessel body. In this example, the vessel body includes a multi-chamber vessel having one or more tubes or passages that fluidically or operably couple the various internal chambers. In the present embodiment, the various components of the water filter may be integrally formed to define a single unitary or monolithic piece or structure.

The example of FIGS. 7A-7B includes a receptacle 706 that is inverted or downward facing. The receptacle 706 may also include a tapered or conical internal surface in accordance with other embodiments described herein. In this example, the receptacle 706 is configured to receive and form a partial seal with a vaporizing apparatus 708. The vaporizing apparatus 708 may be a hand-held vaporizer device having an internal heating element that is configured to heat a liquid product that is contained within an internal chamber or cartridge. The internal heating element may vaporize and/or combust the liquid product, which may include, without limitation, one or more of: an oil, an extract, a solution, a concentrate or a mixture, in order to produce a vaporized product. The vaporized product may be drawn from an outlet of the vaporizing apparatus 708 when the user inhales through the mouthpiece creating a small vacuum at the receptacle 706. As shown in FIGS. 7A-7B, the water filter 700 may be configured to be held in one hand allowing for operation of the vaporizing apparatus 708 with the other hand.

While a vaporizing pen or hand-held vaporizing device is depicted in FIGS. 7A-7B, other vaporizing apparatuses may also be used in conjunction with the receptacle 706, which may have a tapered or conical internal surface. Similar to other examples, the tapered or conical internal surface of the receptacle 706 may be sand blasted or otherwise be treated to facilitate a seal between the receptacle 706 and an article, like a vaporizing apparatus or a rolled product. In some implementations, a vaporizer bucket similar to the vaporizer bucket 682 of FIG. 6B, may be specially adapted for use with the inverted receptacle 706 of FIGS. 7A-7B. Specifically, a vaporizer bucket may have a hollow tube or neck that allows for the bucket be in an upwards or upright configuration while the vaporizer bucket is inserted in the inverted receptacle 706. Similar to the vaporizer bucket 682 of FIG. 6B, such a vaporizer bucket may also have a tapered protrusion that is configured to be received by and form a seal with the tapered or conical internal surface of the receptacle 706.

It should be generally understood from the above description that the present disclosure is not limited to the particular shapes, sizes, and features described above with respect to FIGS. 1A-7B. For example, a variety of vessel body shapes, receptacle shapes, and mouthpiece shapes are contemplated within the present disclosure. A variety of lengths and shapes of downtubes are also contemplated, with the above examples given for illustrative purposes. In addition, embodiments of the present disclosure may omit or add features such as those described above.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

What is claimed is:

1. A water filter for inhaling a combustible or vaporized product, the water filter comprising:

a vessel body having an outer wall formed from a vessel material and that defines an external surface of the water filter and an internal cavity configured to retain a liquid, the vessel body configured to be held in the hand while inhaling the combustible or vaporized product;

a mouthpiece integrally formed with the vessel body from the vessel material and extending from an upper portion of the vessel body, the mouthpiece defining an opening through the outer wall;

a receptacle integrally formed with the vessel body from the vessel material and defining a conical internal surface that is configured to receive an article for producing the combustible or vaporized product; and a downtube extending into the internal cavity from the receptacle and integrally coupled to an inner surface of the outer wall, the downtube defining multiple openings that are proximate the inner surface of the outer wall and that are configured to direct combusted or vaporized material from the combustible or vaporized product into the retained liquid.

2. The water filter of claim 1, wherein:

the downtube has a chamber that is defined, in part, by the outer wall of the vessel body;

the downtube meets the inner surface of the outer wall at a seam; and the multiple openings are positioned along the seam.

3. The water filter of claim 1, wherein:

the vessel material is a glass material; and the vessel body, the mouthpiece, the receptacle, and the downtube are integrally formed to define a unitary monolithic piece.

4. The water filter of claim 1, wherein the conical internal surface is configured to form a seal between the article and the receptacle.

5. The water filter of claim 4, wherein the conical internal surface has a sand blasted surface finish that facilitates the seal between the article and the receptacle.

6. The water filter of claim 1, wherein:

the water filter further comprises a base configured to support the water filter on a flat surface; and the receptacle extends upward at an angle with respect to the flat surface.

7. The water filter of claim 1, wherein:

the vessel body defines a carburation port; and the carburation port is positioned above the receptacle by a distance that enables the carburation port to be covered by an index finger of a user's hand when the water filter is being held in the hand.

8. The water filter of claim 1, wherein:

the vessel material is a glass material;

the downtube is formed from the glass material; and the downtube is integrally formed with the vessel body to define a single monolithic piece.

9. A water filter for inhaling a vaporized product, the water filter comprising:

a vessel body defining an internal cavity configured to hold water in a lower region of the vessel body;

a mouthpiece extending from and integrally formed with an upper portion of the vessel body, the mouthpiece defining an opening that extends into the internal cavity;

a vaporizer bucket having a flat lower surface surrounded by a wall, the flat lower surface configured to vaporize a product to produce the vaporized product in response to receiving heat from an external source, the vaporizer bucket having an outlet defined along an upper portion of the wall and configured to receive the vaporized product and route the vaporized product to a conical protrusion through a hollow tube;

a receptacle extending integrally formed with the vessel body, the receptacle having an inner conical surface that is configured to receive the conical protrusion of the vaporizer bucket; and a downtube integrally formed with the vessel body and extending from the receptacle into the internal cavity, the downtube having an outlet that is configured to be submerged by the water in the lower region of the vessel body to deliver the vaporized product into the water.

10. The water filter of claim 9, wherein the vaporizer bucket is integrally formed from a glass material.

11. The water filter of claim 10, wherein:

the inner conical surface defines a first internal diameter at an opening of the receptacle;

the inner conical surface defines a second internal diameter located inward of the opening of the receptacle proximate to the vessel body;

the first internal diameter ranges between 10 mm and 20 mm; and the second internal diameter is less than the first internal diameter and ranges between 2 mm and 9 mm.

12. The water filter of claim 10, wherein the inner conical surface includes a textured surface configured to facilitate a seal between the vaporizer bucket and the inner conical surface.

13. The water filter of claim 10, wherein the inner conical surface has an interior angle that ranges between 5 and 10 degrees.

14. The water filter of claim 9, wherein an outer surface of the conical protrusion and the inner conical surface of the receptacle are textured to facilitate a seal between the vaporizer bucket and the receptacle.

15. The water filter of claim 9, wherein:

the vessel body includes an outer wall that defines the internal cavity;

the downtube comprises a chamber that is configured to receive combusted or vaporized product received at the receptacle;

the chamber is defined, in part, by the outer wall of the vessel body; and the chamber includes a chamber wall that defines the outlet that is submerged by the water in the lower region of the vessel body.

16. A water filter comprising:

a glass vessel body having a sidewall defining an internal cavity that is configured to hold water;

a mouthpiece coupled to the glass vessel body and defining an opening into an upper portion of the internal cavity;

a receptacle integrated with the glass vessel body and defining a tapered surface that is configured to form a seal between a vaporizer and the receptacle, the vaporizer configured to heat a liquid product to produce a vaporized product; and a downtube that is integrally formed with the sidewall of the glass vessel body and operably coupled to multiple openings that are proximate the sidewall of the glass vessel body and that are configured to transfer the vaporized product from the receptacle to the water.

17. The water filter of claim 16, wherein the vaporizer is a hand-held device having an internal heating element that is configured to heat the liquid product.

18. The water filter of claim 16, further comprising a carburation port defining an aperture in the glass vessel body positioned between the receptacle and the mouthpiece.

19. The water filter of claim 16, wherein:

the downtube includes an internal passage configured to transfer smoke or the vaporized product from the receptacle; and the internal passage is defined, in part, by an inner portion of the sidewall of the glass vessel body.

* * * * *